United States Patent [19]

Boucraut

[11] 4,362,082

[45] Dec. 7, 1982

[54] WEAVING LOOM FOR PROVIDING A LADDERFREE WOVEN FABRIC

[75] Inventor: Frantz M. J. Boucraut, Troyes, France

[73] Assignee: Valton S.A., Troyes, France

[21] Appl. No.: 204,905

[22] Filed: Nov. 7, 1980

[30] Foreign Application Priority Data

Nov. 13, 1979 [FR] France ..... 79 27929

[51] Int. Cl.[3] ..... D04C 5/00

[52] U.S. Cl. ..... 87/24; 87/27; 139/11

[58] Field of Search ..... 139/11, 50; 87/24, 27, 87/3, 4, 62

[56] References Cited

U.S. PATENT DOCUMENTS

| | | | |
|---|---|---|---|
| 695,791 | 3/1902 | Chadbourne | 87/62 |
| 1,135,782 | 4/1915 | Farigoule | 87/27 |
| 1,449,921 | 3/1923 | Stroud | 87/27 |
| 1,617,347 | 2/1927 | Phily | 139/11 |
| 1,683,052 | 9/1928 | Phily | 139/11 |
| 2,639,733 | 5/1953 | Bamert | 139/50 |
| 2,850,938 | 9/1958 | Pycroft et al. | 87/27 |

FOREIGN PATENT DOCUMENTS

| | | | |
|---|---|---|---|
| 582064 | 11/1946 | United Kingdom | 139/50 |

*Primary Examiner*—Henry Jaudon

*Attorney, Agent, or Firm*—Cushman, Darby & Cushman

[57] ABSTRACT

A loop for providing a ladderless woven fabric made from warp and weft threads and with a stitch-like appearance.

In the loom the warp threads (3) pass into holes of thread guides which are mounted side by side on a shaft (7), rotatably drivable through approximately 180° about its axis between first and second positions; the warp threads (3) initially define triangles at the center of which are provided openings (14) for the insertion therethrough of weft threads. During the forward rotating movement, the threads (3) close around the weft thread, and the latter leaves the thread guides by way of slots (15), after which, as the thread guides execute a return stroke, the triangles reform around the openings (14).

8 Claims, 10 Drawing Figures

WEAVING LOOM FOR PROVIDING A LADDERFREE WOVEN FABRIC

Figure 1:
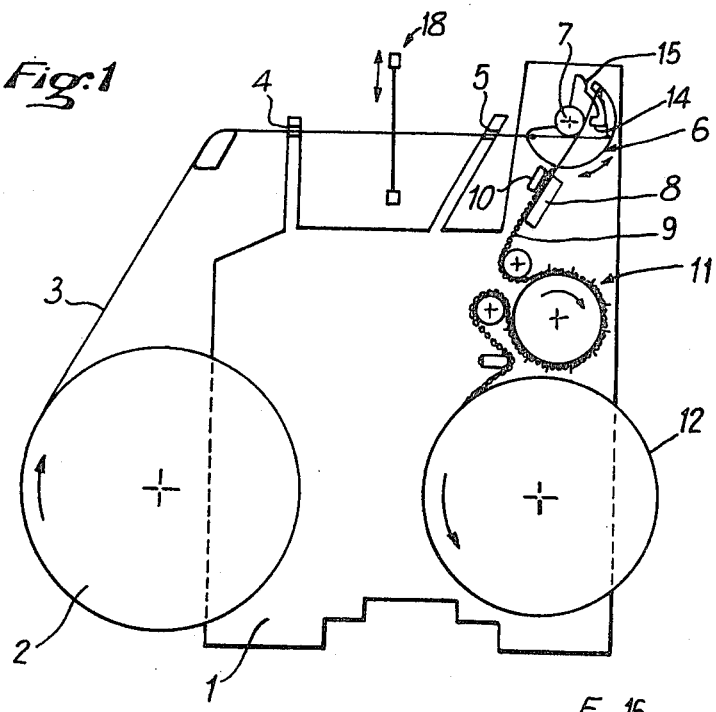

The invention concerns looms for weaving cloth having warp and weft threads, in which looms loops are formed in the warp threads; weft threads are inserted through these loops, and the warp threads are then pulled to obtain an interleaved effect resulting from the twisting of the warp and weft threads around one another.

Description of a loom of this type is given in French Patent Specification No. 592 884 (PHILY), which also gives numerous examples of stitches and of knitted patterns which may be obtained with such a loom. Reference is also made to U.S. Patent Specification 1,617,347 and to UK Patent Specification No. 430239.

The present invention aims to improve looms of the above type. In looms of this type the formation of the loops (which takes place with the warp threads) is accomplished with the assistance of stationary guide threads, relative to which the formed woven fabric is shifted along a semicircular path by means of a workbar, whilst a reed (which moves between the adjacent thread guides) serves to thrust outside those thread guides the weft threads which have been introduced into the loops formed by the warp threads.

The looms to which reference has been made in this document have been known from 1924, and they have been manufactured, sold and used in Europe up to 1950. Numerous, successive improvements have been made to these looms with a view to increasing their working speed. In spite of these efforts their hourly production has remained low, and is inadequate in view of the rates of production which have to be realised at the present time. The reason for this state of affairs is simply that, as the thread guides are stationary, the woven fabric or cloth has to be shifted, and this woven fabric is bulky, heavy, and difficult to guide, so that the cloth may only be moved by imparting rather slow movements to it.

Furthermore, the necessity of using a reed, which passes between the thread guides, makes it necessary to give to the thread guides, a mutual separation which is such that it is impossible to realise a very fine gauge loom or even a simply fine gauge loom.

This form of construction of the PHILY looms, known up to the present time, has seemed to be inevitable because—as is also the case with the looms from which these PHILY derive—the weft thread has to be thrust against, or beaten up to, the woven fabric, when this weft thread emerges from the thread guide.

The main object of the present invention is that of considerably increasing the speed of production of fabric in the looms in question, and of maintaining the woven fabric stationary, and also that of suitably beating up each weft thread against the preceding threads without the use of a reed passing between the thread guides.

According to the invention, there is provided a loom for weaving fabric having warp and weft threads, comprising a common support shaft, thread guides fixedly mounted side by side on said common support shaft, each of which thread guides has a substantially semicircular outer edge, at least two holes through which an associated warp thread may pass successively, an opening for the insertion of weft threads through the assembly of thread guides, and a slot which connects the opening of each said thread guide with the outer edge thereof, wherein the common support shaft has a longitudinal axis and is drivably mounted for rotation between a first and a second position through an angle of approximately 180° about said axis, wherein the semicircular outer edge of the thread guides has a centre substantially coinciding with said axis, wherein said at least two holes are provided in each thread guide at locations close to said outer, semicircular edge of said guide, wherein said slot is curved in a direction opposite to the direction of rotation executed by the thread guide in moving from the first to the second position, and wherein there is provided a stationary table for supporting the woven fabric produced by the loom, which table is associated with a control plate and is positioned in a plane which includes said axis at a point located substantially diametrically opposite the last hole of said at least two holes through which warp thread passes when the thread guide is in its first position, each warp thread passing from said last hole towards said stationary table, wherein the insertion of the weft thread into said openings by said guides takes place whilst said guides are in said first position and said weft threads leave said slots when the thread guides are in their said second position.

Preferably, the slots formed in each thread guide between the opening, provided for inserting the weft threads, and the outer edge of the thread guide, has a curvature whose radius relative to the geometric axis of the shaft carrying the thread guide, increases as a function of the angle formed by the radius referred to with the radius passing through the opening of the slot on the outer edge of the thread guide.

In a loom embodying the invention the warp threads arrive from a warp beam and pass through suitable guide rings, whence they arrive to their respective thread guides. Means, known per se and which serve to hold the warp threads at a constant tension during the rocking movements of the thread guides, are positioned between the guide rings.

According to a modification of the invention, the last guide ring lies in the vicinity of each thread guide in radial alignment with the location of the angle or tip of the isosceles triangle when the thread guides occupies their first, end position prior to the forward stroke of the alternating rocking movements. When the last guide ring is located in this position it is possible to dispense with the hole formed in each said guide at the angle or tip of each isosceles triangle.

Figure 2:
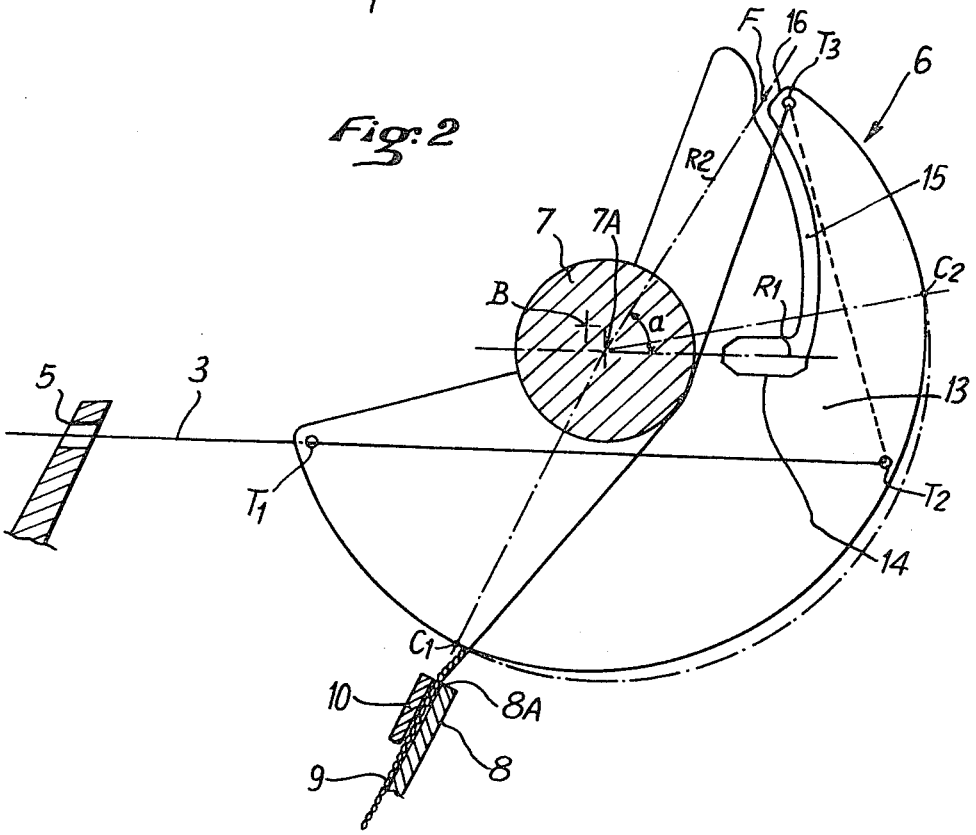

Embodiments of the invention will now be described with reference to the accompanying drawings, in which:

FIG. 1 is a schematic side view showing the relative positioning of the main organs of a loom embodying the invention, FIG. 2 is a side view of a thread guide embodying the invention and forming part of the loom of FIG. 1, FIGS. 3 to 10 are views showing the successive positions adopted by each thread guide during the rocking movements imparted to the guide thread assembly of the loom shown in FIG. 1.

The weaving loom shown in the drawings comprises a main frame 1 supporting various parts of the loom. Further description of the loom will be limited to the main components thereof enabling an understanding of the present invention; the other components and parts of the loom being known. Frame 1 carries a warp beam 2, around which a large number of warp threads 3 are wound. The warp threads 3 are guided, via guide rings 4 and 5, to a large number of thread guides 6, carried fixedly, side by side, on a common shaft 7. Shaft 7 is drivable by a suitable mechanism coupled to at least one of its ends to rock about its longitudinal axis 7A, through an angle of approximately 180° (this will be described in greater detail below). A stationary table 8, is carried on the frame 1 and acts to support the woven fabric 9 produced by the loom. A control plate 10 is associated with table 8 and is movable away from and toward table 8. The control plate 10 is located above table 8, and serves to hold the fabric 9 against table 8 and to prevent the fabric 9 flapping. Control plate 10 is lifted away from table 8 from time to time to allow the fabric 9 to move downwardly. Below table 8 the frame 1 supports a group 11 of cylinders by means of which the woven fabric 9 is guided and a state of constant or regular tension applied to it. A cloth beam 12 is carried by frame 1 beneath the group 11 of cylinders to take up the woven fabric.

Reference will now be made to FIG. 2 for the purpose of describing the way in which the thread guides 6 are formed. Each guide 6 is a planar element of thin sheet metal and is secured (by means not shown) to the common shaft 7. As no movable or stationary components are located between adjacent thread guides 6 a large number of thread guides 6 may be mounted on the common shaft 7 and they can lie very close to one another. Thus a fine gauge loom may be achieved.

Each thread guide 6 has a substantially semicircular profile (which preferably extends through an angle between 180° and 230°) the semicircle coinciding with the longitudinal axis 7A of common shaft 7. Three holes T1, T2, T3 are provided as shown close to the periphery of each guide thread, so that a warp thread 3 may pass therethrough. It is of course possible—if it is thought desirable for the appearance of the cloth to be produced (or for reasons associated with the use to which the cloth is to be put)—to arrange for several warp threads 3, joined to one another, to pass at the same time, through the holes T1, T2, T3. It is also possible (for similar reasons), to supplement the hole T2 by an adjacent line hole (not shown) and to arrange for a thread to pass through the holes T1, T2, T3 and for a second thread to pass into the hole T1, into the supplementary hole which is provided in adjacent hole T2, the second thread then passing into the hole T3. It should also be noted (and this will be explained in detail below) that the provision of hole T1 is provisional insofar as the last guide ring 5 lies sufficiently close to the thread guide 6, and is supported at a suitable level, to fulfill the function carried out by hole T1.

The holes T2 and T3 are situated at equal radial distances from the axis 7A of the common shaft 7. The holes T2, T3 and hole T1 are spaced from one another and lie at the apexes or corners of an isosceles triangle the base of which is defined by holes T2 and T3, the bisector of this isosceles triangle substantially constitutes a diameter of the thread guide 6. This preferred arrangement is not mandatory; the condition which it is essential to observe is the following. When the thread guides 6 are at one of the end or extreme positions of their rocking motion with the common shaft 7 (as shown in FIG. 2) each warp thread arriving from the guide ring 5 passes through the hole T1 (or through a point lying substantially at the location of the hole T1 if the latter is not actually provided) and then passes through the hole T2, finally passing through the hole T3 before passing round common shaft 7, and thence to the table 8. By following this path of travel each thread 3 defines, on its associated thread guide, a large triangle indicated by reference symbol 13. By means of this it is possible to define the relative position of firstly the guide ring 5 and the hole T1, of secondly the holes T2 and T3 and of finally the table 8. Table 8 must lie closer to the hole T1 than the two holes T2, T3. The upper edge 8A of the table 8 lies only a short distance away from the periphery of the thread guide 6, and the plane of the surface of the table 8, on which the woven fabric 9 rests, is a plane passing through the longitudinal axis 7A of the common shaft 7, and cuts radially through all the thread guides 6. Finally, the table 8 is located substantially diametrically opposite to the last hole T3, from which the warp threads 3 pass to the table 8.

Between the base T2, T3 of the triangle T1, T2, T3 and the common shaft 7—and, consequently, inside this triangle and also inside the triangle 13—each thread guide 6 has an opening 14 through which weft threads may be inserted. All the openings 14 are in strict mutual alignment, and their profile shape is selected as a function of that of the means used for passing the weft thread into the inside of the triangular loops 13 formed by the warp threads 3. By means of a curved channel or slot 15 communication is established between each opening 14 and the outer, semicircular edge of the thread guide 6, at a position lying outside the segment corresponding to the base T2, T3 of the triangle T1, T2, T3. From the opening 14 slot 15 is curved in a direction opposite to the direction of rotation of the thread guides 6 during the first stroke of their rocking movements. Stated differently, when the thread guides 6 are at their first extreme position, that is to say in their starting position, the holes T3 lie at a level above that of the holes T2 and, if it is assumed that the movement first takes place in the clockwise direction (when looking at FIG. 2), the curved slot 15 opens out above the hole T3 on each thread guide 6.

From its start to its finish the slot 15 extends over an angle a, referred to the centre of the thread guide 6 and the axis 7A of common shaft 7. The starting zone from the opening 14, and the radius of curvature of the slot 15, are chosen such that the weft threads may leave the openings 14 without difficulty, and may travel with a regular movement until they reach the outside of the thread guide 6 during the first stroke of the movements of the thread guide (this will be explained further below). In accordance with a pattern found to be satisfactory the radius of the slot 15, referred to the axis 7A, increases as a function of the increase in the angle it makes with the line joining the axis 7A and opening 14; with increasing distance from the opening 14. The slot 15 has a radius R1 at the opening 14, and a radius of R2 at its outermost end zone F, the increase from R1 to R2 being proportional to the increase in value of the angle the final value of which is a.

The active edge of each thread guide 6 is its semicircular edge which, as a whole, is a half circumference centred on axis 7A. In practice it has been found satisfactory to slightly set back the active edge between a point C1, lying opposite the table 8 when the thread guides are in their start positions and a point C2, located at a radius passing between the two holes T2 and T3. In FIG. 2 the circumference, whose centre is 7A, is represented in chain-dotted line between the points C1 and C2, and in continuous line outside these two points. The actually existing edge of the guide 6 between the points C1 and C2 is shown in continuous line. It will be seen that the circumference in question is centred on B, which is displaced a short distance from the axis 7A. The reason for moving the active edge of the thread guide 6 will be explained below; the way in which the extent to which this active edge is cut-back will also be explained below.

To ensure that the weft threads may leave each slot 15 without striking against this slot, a rounded portion is provided at 16 between the outermost edge of the slot 15 and the other edge of the thread guide. The hole T3 is also very close to the outer edge of the slot 15.

Reference will now be made to FIGS. 3 to 10 in explaining the operation of the loom.

Figure 3:
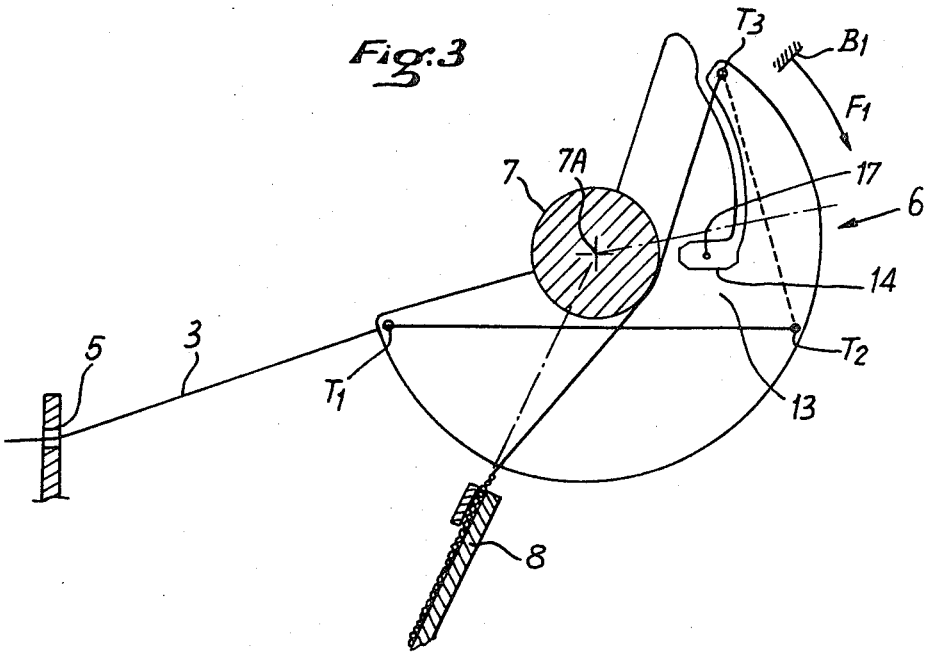

FIG. 3 shows shaft 7 and thread guides 6 occupying one of their end positions (which is suggested by a schematic abutment B1) which position is that shown in FIGS. 1 and 2. In this position the threaded warp threads 3 pass through the holes T1, T2 and T3. FIG. 3 illustrates the modification referred to above by which the final guide rings 5 are not located in places enabling them to fulfill the role of the holes T1. Thus, these holes T1 are provided in the thread guide and the warp threads 3 pass through them. A weft thread 17 is inserted through the assembly of openings 14, each of which is surrounded by an associated one of the triangular loops 13 formed by warp threads 3. Any suitable known means can be used for this purpose for inserting or throwing the weft thread into and through the openings 14.

Figure 4:
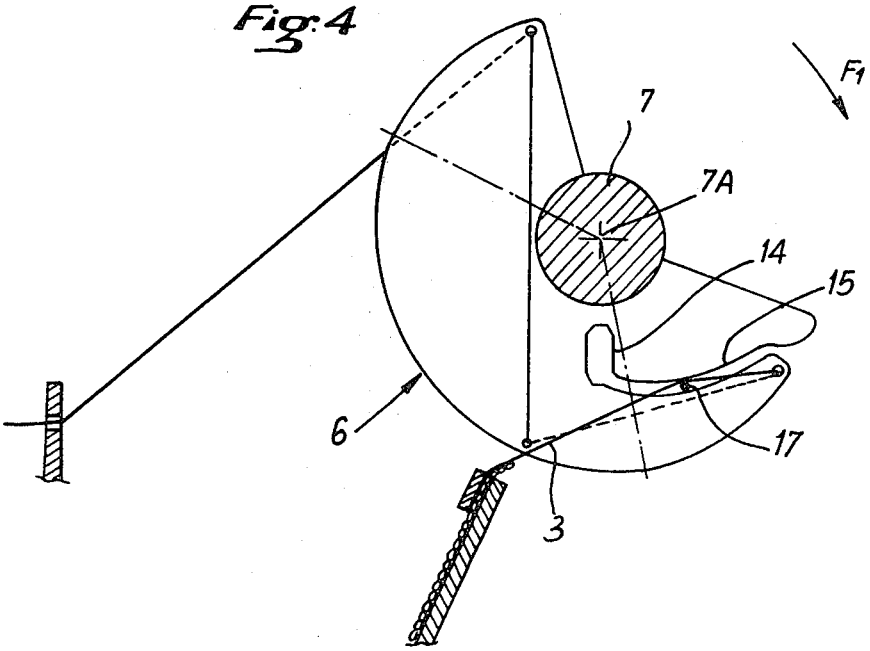
Figure 5:
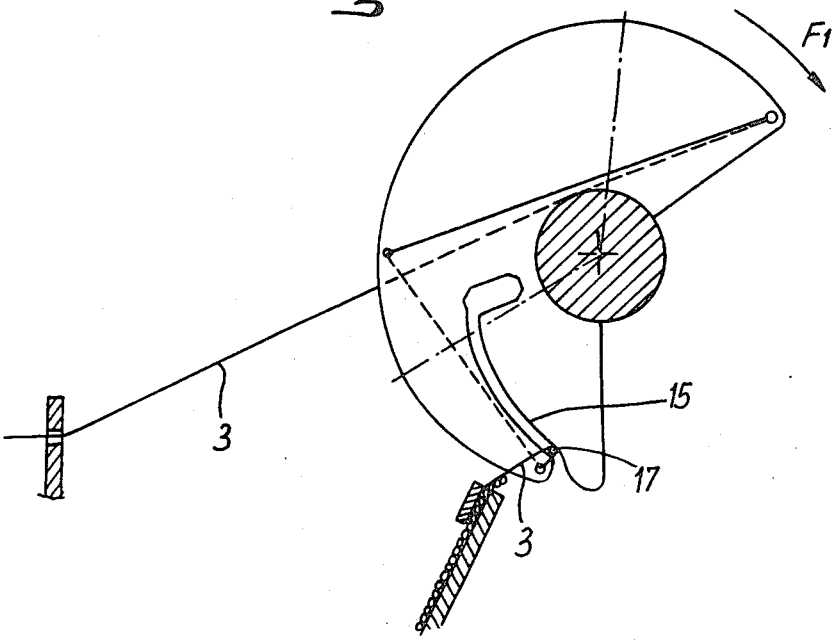

The shaft 7 and thread guides 6 then execute their first, forward clockwise working stroke from the abutment B1 as indicated by an arrow F1; this first, working stroke is in the form of a rotating movement about the axis 7A. During this movement the loops 13 of the warp threads 3 close around the weft thread 17 and pull the latter outside the openings 14 and thus into the channel or slot 15 (FIG. 4).

Figure 6:
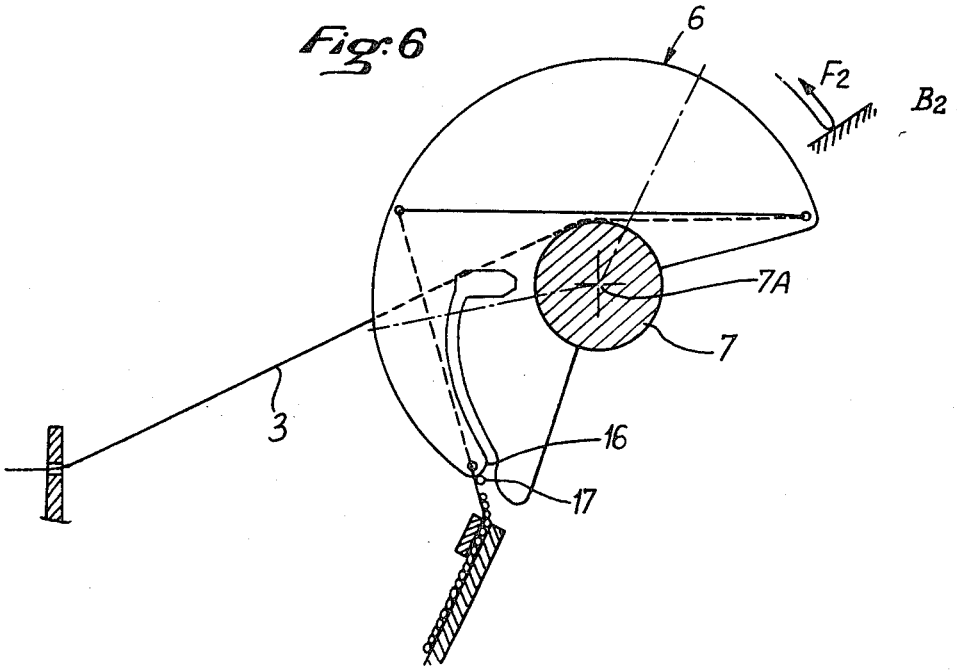
Figure 7:
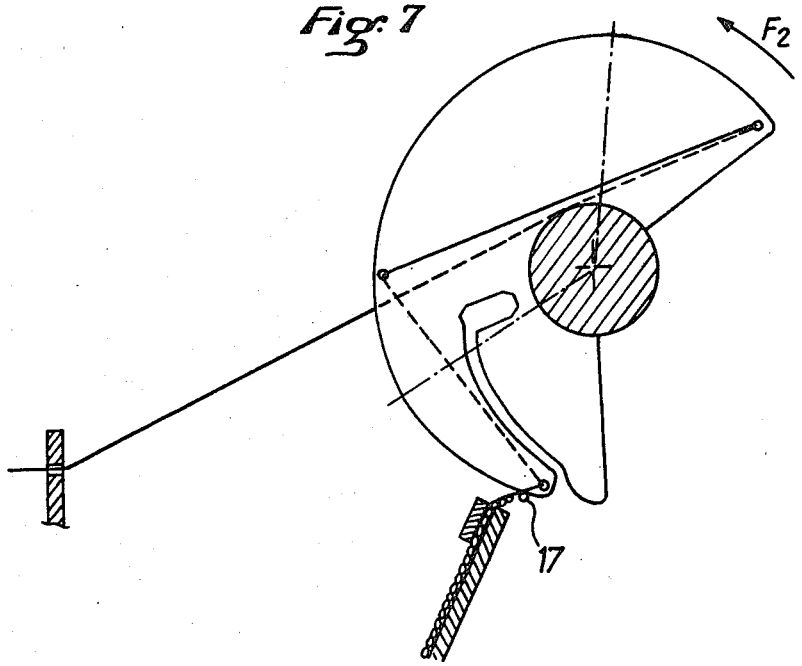

Towards the end of this movement the warp threads 3 have completely closed round the weft thread 17, and the latter reaches the end of the slots 15 (FIG. 5); the weft threads 17 then leaves the slot 15 and slides along the rounded portion 16, whence it arrives at the outer edge portions of the thread guide 6. This situation marks the end of the forward stroke of the thread guide; the shaft 7 and the thread guides 6 are in their second end position, which is suggested by a schematically drawn abutment B2 (FIG. 6).

Figure 8:
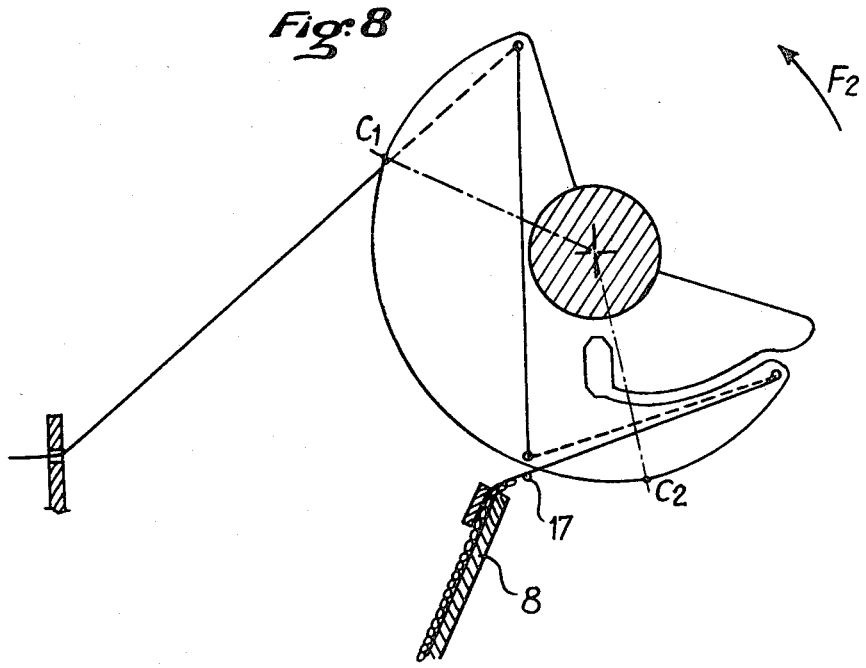
Figure 9:
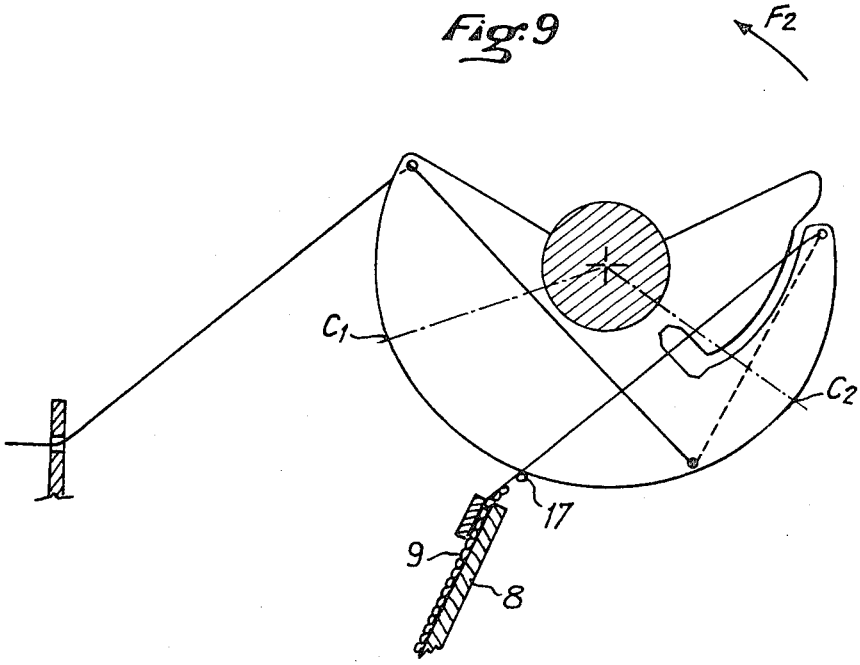

The shaft 7 and the thread guides 6 then start their return stroke, in which they rotate, in the anticlockwise direction F2, about the axis 7A. During this movement the weft thread 17 slides along the outer edge of the thread guides 6 (FIGS. 7 to 10) up to the points C2. As the edge of the thread guides 6 are set back over the region from point C2 to point C1, friction between the weft thread 17 and the thread guide in this region assumes a zero value or, is at least very greatly reduced (FIGS. 8 and 9). The reason for this provision is to prevent the thread guides 6 drawing, by friction, the weft thread 17 and moving it away from the table 8 whilst the thread guides are rotating in direction F2.

Figure 10:
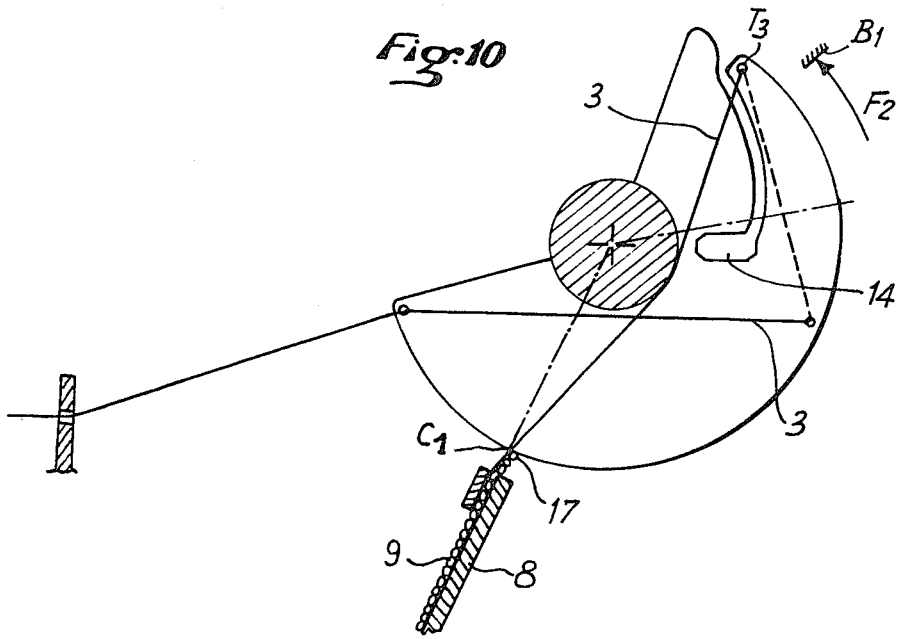

The extent to which the edge of the thread guides 6 is set back between points C2 and C1 may easily be determined by observation. Sometimes it will be possible to dispense with this setback portion, depending on the nature of the weft threads 17, as the extent to which these weft threads are liable to be pulled by the edge of the thread guides 6 varies. The position of point C2 may also be varied. On the other hand, the position of point C1 is more strictly determined. It is necessary to ensure that, at the moment at which the thread guides 6 arrive at their starting position (at the end of their return stroke) the thread guides 6 press the most recent weft thread 17 against those weft threads of the woven fabric 9 which have preceded it. This thrusting action takes place when the holes T3, from which the warp thread 3 pass directly to the woven fabric 9, approach their initial position in which they lie substantially diametrically opposite the table 8 and the woven fabric 9 supported thereon (FIG. 10). At this instant the radius of the edge of the thread guides 6 progressively returns to its value relative to the longitudinal axis 7A, and once again assumes this value at C1, as is particularly shown in FIG. 2.

When the common shaft 7 and the thread guides 6 have returned to their 'start' position the threads 3 once again form loops around the openings 14, and a new weft thread may be passed through these openings.

During the back and forth rocking movements of the shaft 7 and of the thread guides 6, the warp threads 3 are initially pulled until the forward working stroke has ended (FIG. 6); at which time they are released until the guides are again in their starting positions. The excess of the warp thread, which has pulled out, is taken up by a mechanism by means of which a constant tension is imposed on the warp thread; this mechanism may be of any suitable kind known per se, such as the mechanism 18 which is schematically illustrated in FIG. 1 and lies between the guide rings 4 and 5. This mechanism 18 is also supported by the frame 1 of the loom.

The invention makes considerable improvements in the known looms of the type in question. One such improvement, already referred to, is that very fine gauges cloth may be woven, as no reed is required to engage between the thread guides 6 and to beat up the weft thread 17. A further improvement is the small angle (180° approximately) through which the thread guides need to rotate. Again the assembly comprising the shaft 7 and of the thread guides 6 is the only rapidly moving part of the loom and the weight of this assembly is relatively low so that it can be well dynamically balanced and the loom can then operate at a very high working speed.

The design of the thread guides according to the invention enables the openings 14 to be positioned close to the shaft 6, and thus in an area of high rigidity. This reduces the risk of vibration of the thread guides, and enables the use of rapiers or projectiles for picking (inserting) the weft threads 17. Also, the holes T1, T2 and T3, through which the warp threads 3 are intended to pass, can lie right on the periphery of the thread guides 6. This facilitates the initial threading of the warp threads.

The known looms formed in accordance with the teaching of French Patent Specification No. 592 884, did not exceed a production rate of approximately 4 meters of cloth per hour, at a width of some 1.60 m. By contrast a loom embodying the invention herein described can produce about 12 m of cloth per hour of the same width.

I claim:

1. A loom for weaving fabric having warp and weft threads, comprising a common support shaft, thread guides fixedly mounted side by side on said common support shaft, each of which thread guides has a substantially semicircular outer edge, at least two holes through which an associated warp thread may pass successively, an opening for the insertion of weft threads through the assembly of thread guides and a slot which connects the opening of each said thread guide with the outer edge thereof, wherein the common support shaft has a longitudinal axis and is drivably mounted for rotation between a first and a second position through an angle of approximately 180° about said axis, wherein the semicircular outer edge of the thread guides has a centre substantially coinciding with said axis, wherein said at least two holes are provided in each thread guide at locations close to said outer, semicircular edge of said guide, wherein said slot is curved in a direction opposite to the direction of rotation executed by the thread guide in moving from the first to the second position, and wherein there is provided a stationary table for supporting the woven fabric produced by the loom, which table is associated with a control plate and is positioned in a plane which includes said axis at a point located substantially diametrically opposite the last hole of said at least two holes through which warp thread passes when the thread guide is in its first position, each warp thread passing from said last hole towards said stationary table, wherein the insertion of the weft thread into said openings by said guides takes placed whilst said guides are in said first position, and said weft threads leave said slots when the thread guides are in their said second position.

2. A loom according to claim 1, wherein each said thread guide has three said holes, respectively located at the apexes or corners of a triangle, for the passage of warp thread therethrough and wherein said three holes lie close to the semicircular edge of the thread guide at equal distances from said longitudinal axis of said common shaft.

3. A loom according to claim 2, wherein said three holes lie at the apexes or corners of a substantially isosceles triangle, the bisector of the base of said triangle substantially coinciding with a diameter of the thread guide.

4. A loom according to claim 1, wherein each thread guide has two said holes and a guide ring for guiding the warp thread to the thread guide is supported outside the thread guide at a position in which said guide ring functions as a third hole.

5. A loom according to claim 1, wherein the stationary table lies with its upper edge close to the outer edge of the thread guide.

6. A loom according to claim 1, wherein the curved slot reaches the outer edge of the thread guide outside the segment thereof delimited by said at least two holes, and a rounded portion connects the outermost edge of the slot to the outer edge of the thread guide.

7. A loom according to claim 1, wherein the slot starts at the opening with a radius of value R1 referred to said axis, and ends with a greater radius R2, and wherein the increase in radius from R1 to R2 is proportional to the angle included by the two radii with increasing distance from the opening.

8. A loom according to claim 1, wherein the outer edge of each said thread guide is set back relative to the correct semicircular profile between a point located on the periphery on a radius passing between the two holes and a point located at the periphery opposite the stationary table when the shafts and the thread guides are in their said first position.

* * * * *